US010234241B2

(12) United States Patent
Strum

(10) Patent No.: US 10,234,241 B2
(45) Date of Patent: Mar. 19, 2019

(54) PROTECTIVE WEARABLE CARRIAGE DEVICE AND METHOD

(71) Applicant: Velocity Systems, LLC, Dulles, VA (US)

(72) Inventor: David B. Strum, Amissville, VA (US)

(73) Assignee: Velocity Systems LLC, Dulles, VA (US)

( * ) Notice: Subject to any disclaimer, the term of this patent is extended or adjusted under 35 U.S.C. 154(b) by 815 days.

(21) Appl. No.: 13/655,548

(22) Filed: Oct. 19, 2012

(65) Prior Publication Data

US 2013/0097759 A1 Apr. 25, 2013

Related U.S. Application Data

(60) Provisional application No. 61/549,057, filed on Oct. 19, 2011.

(51) Int. Cl.

| | |
|---|---|
| ***A41D 13/00*** | (2006.01) |
| ***F41H 1/02*** | (2006.01) |
| ***A41D 13/05*** | (2006.01) |
| ***F41H 5/08*** | (2006.01) |
| *A41D 1/04* | (2006.01) |

(52) U.S. Cl.

CPC ..... *F41H 1/02* (2013.01); *A41D 13/0012* (2013.01); *A41D 13/0518* (2013.01); *F41H 5/08* (2013.01); *A41D 1/04* (2013.01)

(58) Field of Classification Search

CPC .... F41H 1/02; F41H 1/00; A41D 1/04; A41D 13/0012; A41D 13/0518

USPC ..... 2/2.5, 463, 464, 467; 224/576, 638, 646, 224/647

See application file for complete search history.

(56) References Cited

U.S. PATENT DOCUMENTS

| | | | | |
|---|---|---|---|---|
| 39,083 | A * | 6/1863 | Vaile | 2/2.5 |
| 5,904,607 | A * | 5/1999 | Abadi | 450/3 |
| 5,918,309 | A * | 7/1999 | Bachner, Jr. | 2/2.5 |
| 7,318,240 | B1 * | 1/2008 | Rendone | A41B 9/08 2/69 |
| 2008/0141428 | A1 * | 6/2008 | Kapah et al. | 2/2.5 |
| 2010/0287681 | A1 * | 11/2010 | Storms, Jr. | A41D 1/04 2/102 |
| 2011/0239346 | A1 * | 10/2011 | Doherty et al. | 2/2.5 |

* cited by examiner

*Primary Examiner* — Katharine Gracz
(74) *Attorney, Agent, or Firm* — Williams Mullen; Thomas F. Bergert

(57) ABSTRACT

A protective, wearable carriage device and method is provided such that the device conforms more substantially to the user's body, facilitates heat dissipation and facilitates modular attachment of different shapes and configurations of armor. In one embodiment of the present invention, a substantially rigid outer frame is provided with an outer surface material and an inner surface mesh material, and the outer frame is secured to an inner frame comprising a cloth netting such that the inner frame and outer frame create a gap between the inner frame and the spacer mesh material. In one embodiment of the present invention, one or more bowing stiffeners are secured to the outer frame so as to facilitate the desirable features of the present invention.

18 Claims, 5 Drawing Sheets

PROTECTIVE WEARABLE CARRIAGE DEVICE AND METHOD

CROSS-REFERENCE TO RELATED APPLICATIONS

The present application claims the benefit of U.S. Provisional Application Ser. No. 61/549,057, filed Oct. 19, 2011 and entitled, "Protective Wearable Carriage Device and Method", the disclosure of which is incorporated herein in its entirety.

FIELD OF THE INVENTION

The present invention pertains to armor-enhanceable, personal, wearable devices, and more particularly to an armor-enhanceable wearable device that is comfortable, breathes easily and is ergonomically superior over prior devices.

BACKGROUND OF THE INVENTION

Military and law enforcement personnel have employed armor-enhanced clothing in order to protect their bodies from gunfire, shrapnel, explosive devices and other harmful ballistic objects. Even when such clothing is sized according to individual specifications (for example, small, medium and large), the armor-enhanced clothing does not generally fit well, gets bunched up, prohibits smooth movement, results in undesirable gaps between body and clothing, has limited contact points with the body, does not wick sweat and water away, becomes uncomfortable and even hinders the withdrawal of firearms. Such disadvantages often result in poor performance and can encourage mis-use or even non-use of these protective devices.

SUMMARY OF ASPECTS OF THE PRESENT INVENTION

The present invention overcomes the current shortcomings and more. The present invention provides a protective, wearable carriage device and method that conforms more substantially to the user's body, facilitates heat dissipation and facilitates modular attachment of different shapes and configurations of armor. The present invention allows maximum user comfort through passive cooling and ergonomic design, with a substantially rigid platform allowing either soft or hard armor (or both) to be modularly attached through various attachment methods. The rigid support is provided, in one embodiment, via bowing stiffeners that create an arch similar to that of the human torso. The present invention can be secured along a user's back and/or front, for example. With the modular attachment capabilities, the present invention can permit a user to employ as many or as few attachments as desired or needed for a given anticipated threat level, incorporating suitable armor to protect the wearer against anything from light ballistics (e.g., sand) all the way up to the heaviest ballistic weaponry and fragments that might be encountered.

DETAILED DESCRIPTION OF EMBODIMENTS OF THE PRESENT INVENTION

Figure 1:
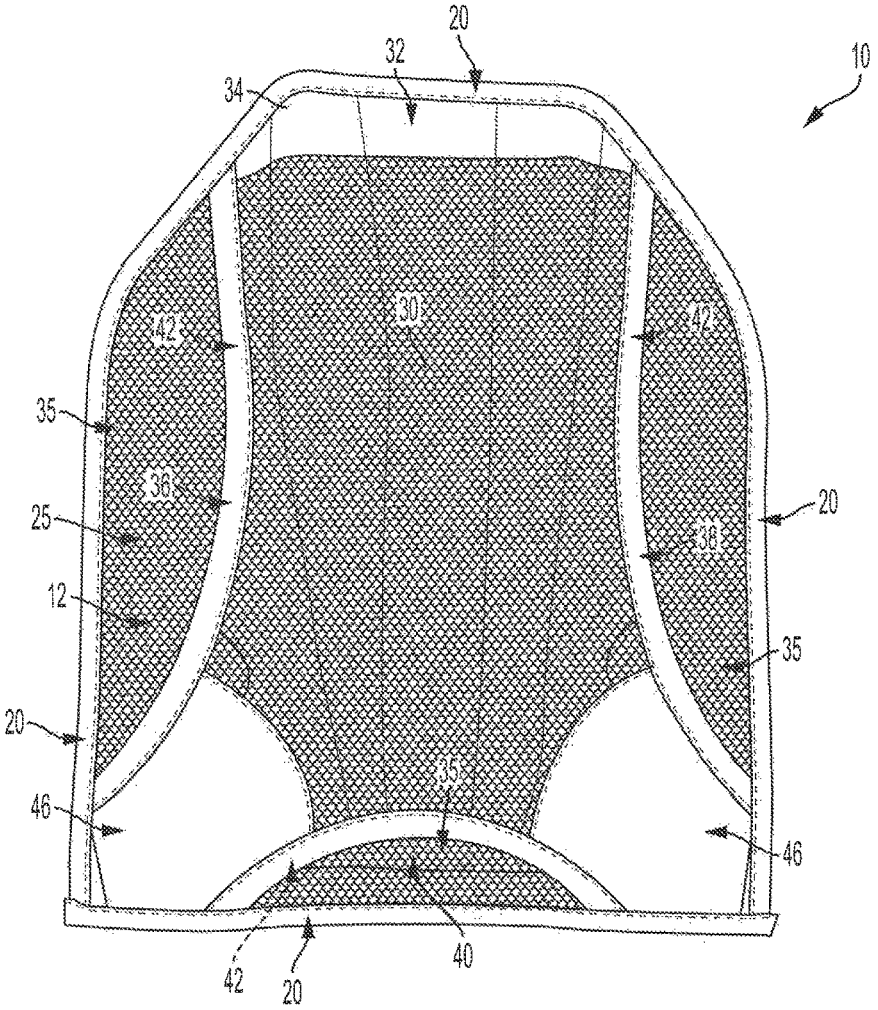
FIG. 1 is a photograph of a front side of one embodiment of the carriage device of the present invention.
Figure 2:
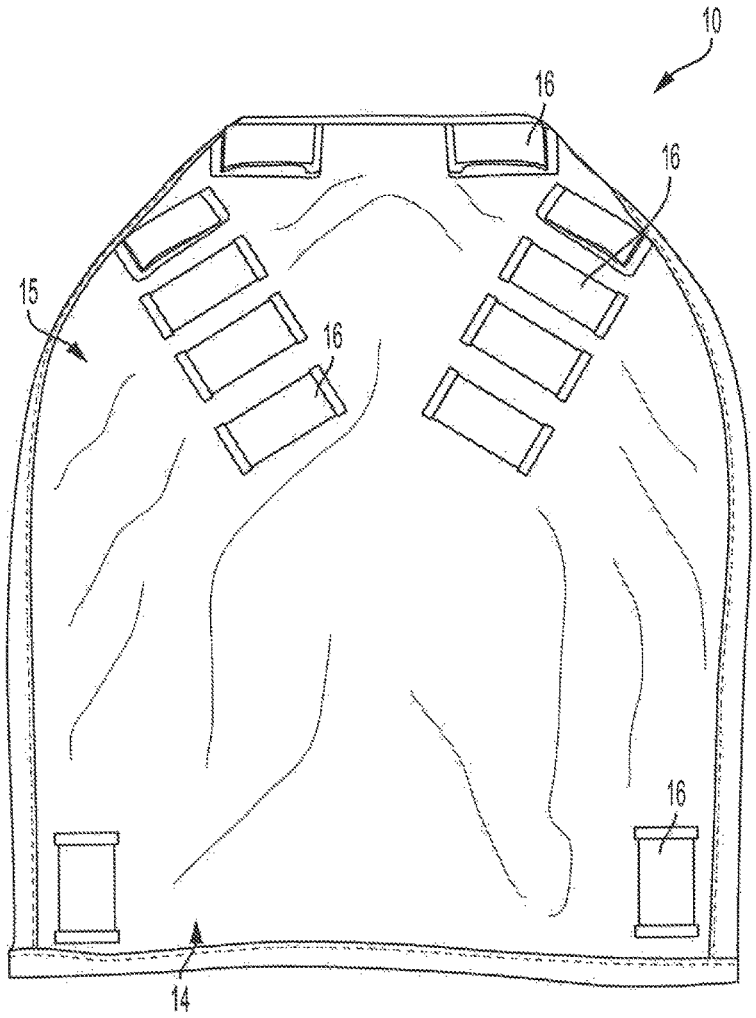
FIG. 2 is a photograph of a back side of the embodiment of the carriage device of the present invention shown in FIG. 1.
Figure 3:
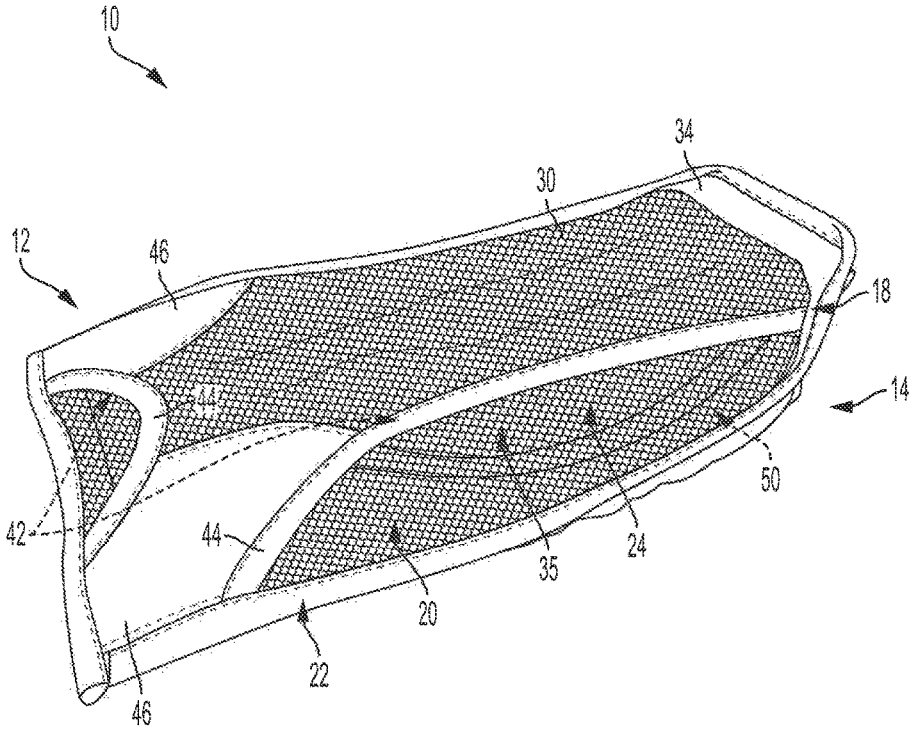
FIG. 3 is a photograph showing a front right perspective view of the embodiment of the carriage device of the present invention shown in FIG. 1.

As shown in FIGS. 1 through 3, one embodiment of the carriage device 10 of the present invention includes a front side 12 and a back side 14. The back side 14 can include a canvas or other suitable material with various attachment members and/or pockets 16 for receiving external attachments, straps, harnesses, gear, armor and other items that may be desired for a given user in a given situation. For instance, an attachment member 16 can be used to hold shoulder straps that are attached to a device worn on the front of a user's body.

The front side 12 of the device 10 is provided with an inner frame 18 that engages an outer frame 20 formed at the intersection of the front 12 and 14 back sides. The outer frame 20 can comprise a substantially rigid material such as a lightweight metal formed either as a unitary member or as individual members with an inner and outer side. The outer side can be secured to material, such as canvas, for example, comprising the outer surface 15 of the back 14 of the device. The frame member(s) can be secured within and/or to the outer surface material 15 by sewing together a seam 22 using seam tape, for example, so as to retain the rigid frame 20. In one embodiment of the present invention, no piping or other rigid frame members are employed, but rather seam tape of sufficient stability is used. Spacer mesh material 24 can also be secured in the outer frame seam 22 to form the internal surface 25 of the back side 14 of the device 10. As a result, in one embodiment of the present invention, the substantially rigid material comprising the frame 20 of the back side 14 of the device can be enveloped within other materials so as to have a canvas or other material on the outer side thereof, a mesh material on the inner side thereof and a seam 22 on the edges thereof that joins the outer surface material to the inner surface material.

As shown in FIGS. 1 and 3, the inner frame 18 can comprise a cloth netting 30 terminating at a top portion 32 in a buffer material 34 that connects the outer frame 20 to the netting 30. The cloth netting 30 further terminates at its sides 36, 38 and bottom 40 at the inner frame areas that employ additional substantially rigid yet somewhat flexible material 42 that is retained within seam tape 44, for example, so as to keep the edges from fraying. As with the outer frame, in one embodiment of the inner frame of the present invention, no piping or other rigid frame members are employed, but rather seam tape of sufficient stability is used. In one embodiment of the invention, a stronger support material 46 is provided along portions of the cloth netting 30 to prevent wear and tear.

Figure 4:
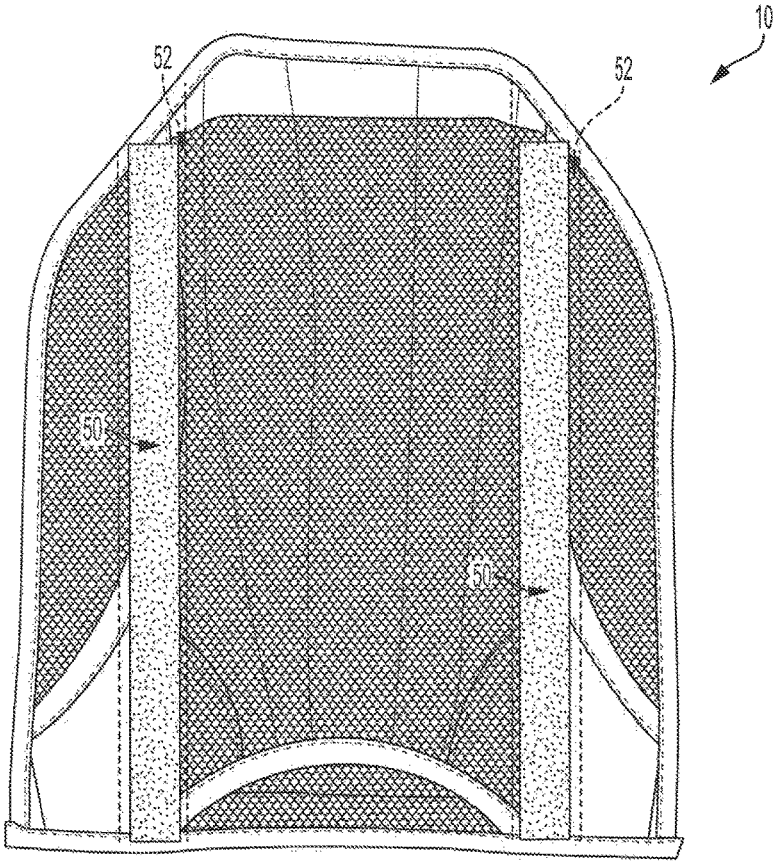
FIGS. 4 and 5 are schematic front views of embodiments of the carriage device of the present invention, showing channels for bowing stiffeners as described hereafter.
Figure 5:
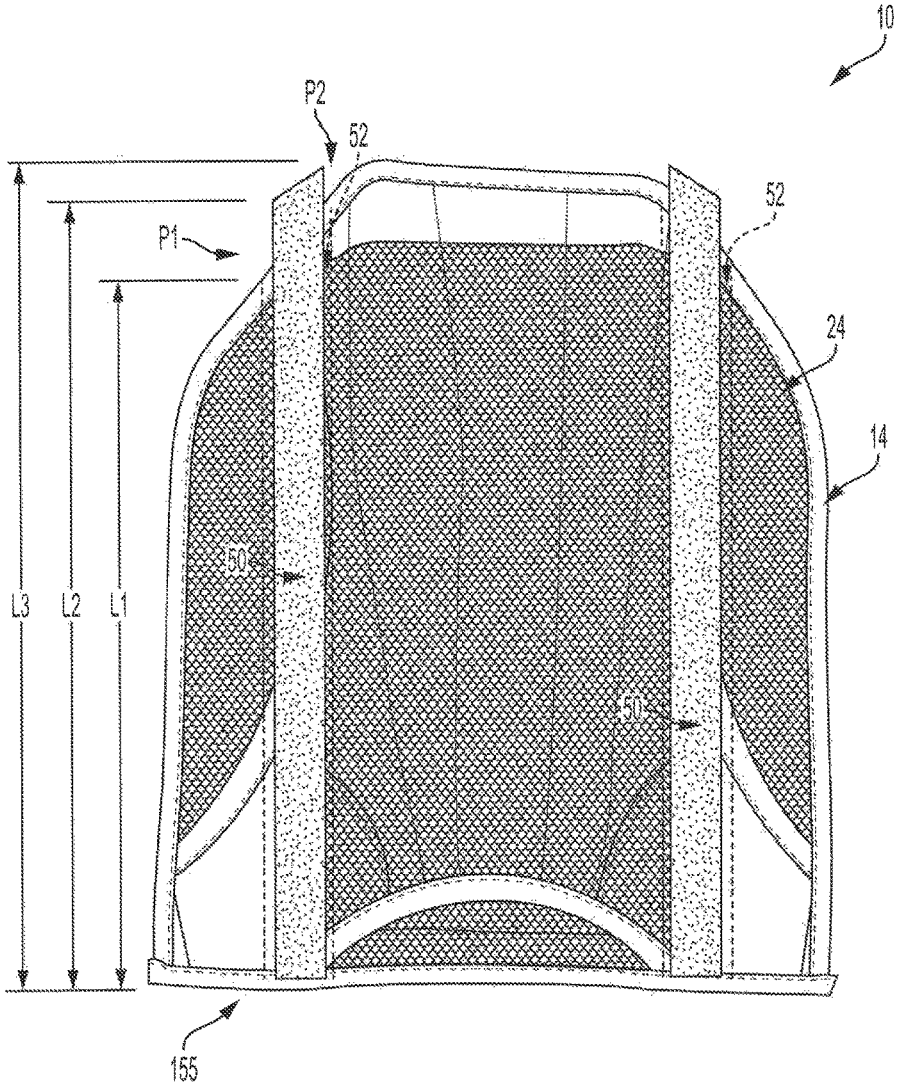

In one embodiment of the present invention, as illustrated in FIGS. 4 and 5, bowing stiffeners 50 are secured between the spacer mesh 24 and the back side 14 material so as to bias the device in a position that better matches the human torso and further creates gaps 35 between spacer mesh 24 and cloth netting 30. In one embodiment of the present invention, the stiffeners 50 can be secured within channels 52 in the back portion 14 of the device. In one embodiment of the present invention, the channels 52 are approximately ½ inch in width and are sewn into the spacer mesh 24, and the stiffeners 50 are then secured within the channels using seam tape as described above, for example. In one embodiment of the present invention, two stiffeners are used in the device, and the stiffeners are slightly longer than their respective channels, causing the stiffener to bow and create the desired shape and space within the device. For example, as shown in FIG. 5, stiffeners 50 that are to be secured within the channels 52 have a length L3 that is longer than the length of the respective channel 52, which is shown extending from the bottom edge 155 of the back portion 14 to the outside channel point P1 at a distance of L1, and from the bottom edge 155 to the inside channel point P2 at a distance of L2. The stiffeners can comprise a stainless steel spring steel material, in one embodiment, which provides a material of lasting durability with desirable rebound and memory characteristics.

As provided, the present invention facilitates positive airflow that allows built up heat to dissipate through the openings 35, cloth netting 30 and spacer mesh 24. The cloth netting 30 is in contact with the user's torso during use, but because it is netting, it does not retain heat like traditional cloth material does. The spacer mesh 24 is separated from the cloth netting 30 due to the bowing stiffeners, thereby allowing improved air flow, and the spacer mesh 24 provides further heat dissipation and air flow. The spacer mesh 24 further provides padding for comfort as it separates the user's body from any armor contained within the device.

In operation, a wearer of the present invention may select a previously installed version, where armor is already installed, or may customize the armor and any other desired attachments on the fly. Further, the selection can be made according to the wearer's size (e.g., small, medium and large).

The ballistic material can comprise, for example, layers of fibers that may comprise a high molecular weight polyethylene material, an aramid fiber, a combination of high performance fibers, or a non-woven thermoplastic composite. Commercially available embodiments of the ballistic material are known as Dyneema™ and Spectrashield™, for example.

It will be appreciated that the protective device of the present invention thus provides a customizable, armor-enhanceable carriage system that conforms better to the user's body with improved heat dissipation and comfort.

It should be understood that the foregoing description and examples are only illustrative of the present invention; the optimum dimensional relationships for the parts of the invention, including variations in size, materials, shape, form, function and the manner of operation, assembly and use, are deemed readily apparent to one skilled in the art, and all equivalent relationships to those illustrated in the drawings and described in the specification are intended to be encompassed by the present invention. Thus, various alternatives and modifications can be devised by those skilled in the art without departing from the invention. Accordingly, the present invention is intended to embrace all such alternatives, modifications, and variances that fall within the scope described above.

The invention claimed is:

1. A personally wearable carriage device, comprising:

a substantially rigid outer frame having an outer side and an inner side, wherein the inner side of the outer frame is formed with at least one channel, with the at least one channel having a channel length;

an outer material secured to or around the outer side of the outer frame so as to form an outer surface;

spacer mesh material secured to or around the inner side of the outer frame so as to form an inner surface;

a seam adjoining the outer material to the spacer mesh material;

an inner frame secured to the outer frame; and at least one stiffener having a length that is greater than the channel length of the at least one channel in the outer frame, wherein the stiffener is secured entirely within the at least one channel so as to bow within the at least one channel and thereby create a gap between the inner frame and the spacer mesh material.

2. The device of claim 1 wherein no piping is employed as the outer frame or inner frame.

3. The device of claim 1 wherein the seam comprises seam tape.

4. The device of claim 1 further including a buffer material connecting at least a portion of the outer frame to at least a portion of the inner frame.

5. The device of claim 1 wherein the inner frame comprises a cloth netting.

6. The device of claim 1 further wherein the inner side of the outer frame is formed with a plurality of channels, and further including a second stiffener secured within and caused to bow within a second one of the plurality of channels.

7. The device of claim 6 wherein the plurality of channels are sewn into the spacer mesh material.

8. The device of claim 6 wherein each of the stiffeners has a stiffener length, each of the plurality of channels has a respective channel length, and wherein each stiffener length is longer than a respective channel length.

9. The device of claim 1 wherein the outer material is provided with one or more attachment members.

10. A method of providing a carriage device, comprising:

providing a substantially rigid outer frame having an outer side and an inner side, wherein the inner side of the outer frame is formed with at least one channel, with the at least one channel having a channel length;

providing an outer material secured to or around the outer side of the outer frame so as to form an outer surface;

providing a spacer mesh material secured to or around the inner side of the outer frame so as to form an inner surface;

adjoining the outer material to the spacer mesh material with a seam;

securing an inner frame to the outer frame; and providing at least one stiffener having a length that is greater than the channel length of the at least one channel, and inserting the stiffener fully within the at least one channel such that the stiffener is caused to bow within the at least one channel and thereby create a gap between the inner frame and the spacer mesh material.

11. The method of claim 10 wherein no piping is employed as the outer frame or inner frame.

12. The method of claim 10 wherein the seam comprises seam tape.

13. The method of claim 10 further including the step of connecting at least a portion of the outer frame to at least a portion of the inner frame with a buffer material.

14. The method of claim 10 wherein the inner frame comprises a cloth netting.

15. The method of claim 10 further including the steps of forming a plurality of channels within the inner side of the outer frame and positioning a second stiffener in a second one of the plurality of channels such that the second stiffener is caused to bow within the second one of the channels.

16. The method of claim 15 wherein the plurality of channels are sewn into the spacer mesh material.

17. The method of claim 15 wherein each of the stiffeners has a stiffener length, each of the plurality of channels has a respective channel length, and wherein each stiffener length is longer than a respective channel length.

18. The method of claim 10 wherein the outer material is provided with one or more attachment members.

* * * * *